US011502463B2

(12) United States Patent
Bönsch et al.

(10) Patent No.: US 11,502,463 B2
(45) Date of Patent: Nov. 15, 2022

(54) CONNECTION APPARATUS WITH VARIABLE ELECTRICAL CONNECTION BETWEEN CONDUCTOR TERMINALS

(71) Applicant: Weidmüller Interface GmbH & Co. KG, Detmold (DE)

(72) Inventors: Matthias Bönsch, Bielefeld (DE); Jörg Richts, Schlangen (DE); Torsten Diekmann, Leopoldshöhe (DE); Bernd Küppers, Cologne (DE)

(73) Assignee: Weidmuller Interface GmbH & Co. KG

( * ) Notice: Subject to any disclaimer, the term of this patent is extended or adjusted under 35 U.S.C. 154(b) by 0 days.

(21) Appl. No.: 16/623,566

(22) PCT Filed: Jun. 12, 2018

(86) PCT No.: PCT/EP2018/065437
§ 371 (c)(1),
(2) Date: Dec. 17, 2019

(87) PCT Pub. No.: WO2018/234088
PCT Pub. Date: Dec. 27, 2018

(65) Prior Publication Data

US 2021/0028586 A1 Jan. 28, 2021

(30) Foreign Application Priority Data

Jun. 23, 2017 (DE) ..... 202017103748.7

(51) Int. Cl.
*H01R 29/00* (2006.01)
*H01R 9/24* (2006.01)
*H01R 13/502* (2006.01)

(52) U.S. Cl.
CPC ..... *H01R 29/00* (2013.01); *H01R 9/2491* (2013.01); *H01R 13/502* (2013.01)

(58) Field of Classification Search
CPC ..... H01R 29/00; H01R 13/62933; H01R 13/629; H01R 13/24; H01R 31/08; H01R 31/085; H01R 13/502; H01R 9/2491
(Continued)

(56) References Cited

U.S. PATENT DOCUMENTS 2,446,232 A * 8/1948 Koenig ..... H01R 13/26 439/712
3,054,078 A * 9/1962 Baschkin ..... H01R 31/08 439/44

(Continued)

FOREIGN PATENT DOCUMENTS

CN 203911180 U 10/2014
DE 2006147 C3 8/1971

(Continued)

*Primary Examiner* — Gary F Paumen
(74) *Attorney, Agent, or Firm* — Laubscher & Laubscher PC

(57) ABSTRACT

A connection apparatus for connecting electrical devices, in particular electric motors to an AC system, has a housing which has at least one housing portion. A plurality of first and second conductor terminals are arranged in the at least one housing portion. Each conductor terminal has at least one or two or more individual terminals and a configuration plug. The configuration plug electrically connects individual or a plurality of the first and/or second conductor terminals in at least two different positions in order to obtain at least two different circuit types. The configuration plug is rotatably or slidably guided in or on the housing or at least on the at least one housing portion. Due to this relative movement, plug can be rotated and/or displaced into at least two different positions, in order to provide the at least two different circuit types.

11 Claims, 9 Drawing Sheets

(58) Field of Classification Search
USPC ..... 439/49–53, 509–513
See application file for complete search history.

(56) References Cited

U.S. PATENT DOCUMENTS 3,533,044 A * 10/1970 Springfield ..... H01R 13/6596 439/49
4,718,853 A * 1/1988 Orbanic ..... H01R 29/00 200/292
4,773,867 A * 9/1988 Keller ..... H04Q 1/142 379/325
4,856,999 A * 8/1989 Flohr ..... H01R 31/06 439/52
5,000,699 A * 3/1991 Nadin ..... H01R 31/08 439/189
5,190,460 A * 3/1993 Emani ..... H01R 4/2429 439/180
6,616,460 B1 * 9/2003 Shimirak ..... H01R 13/701 439/49
6,749,451 B2 * 6/2004 Schmitt ..... H01R 27/00 439/218
6,992,257 B2 * 1/2006 Follingstad ..... H01H 23/006 200/51 R
7,317,168 B1 * 1/2008 Monserrat ..... H01H 19/46 200/11 R
7,566,226 B2 * 7/2009 Roemer ..... H01R 9/2408 200/16 R
2014/0120750 A1 5/2014 Johnson

FOREIGN PATENT DOCUMENTS

DE 20301077 U1 4/2003
DE 60007846 T2 12/2004
DE 102008010150 A1 9/2009
DE 102008025432 A1 9/2009
DE 202010012519 U1 10/2011
EP 0001208 A1 4/1979

* cited by examiner

Delta position

Neutral position

Star position

CONNECTION APPARATUS WITH VARIABLE ELECTRICAL CONNECTION BETWEEN CONDUCTOR TERMINALS

This application is a § 371 National Stage Entry of International Patent Application No. PCT/EP2018/065437 filed Jun. 12, 2018. Application No. PCT/EP2018/065437 claims priority of DE 20 2017 103 748.7 filed Jun. 23, 2017. The entire content of these applications is incorporated herein by reference.

BACKGROUND OF THE INVENTION

The invention relates to a connection apparatus for connecting electrical devices.

A generic connection apparatus is known from DE 2010 012 519 U1.

For placing AC electric motors into operation, it is known to operate them in a star connection, so that the starting torque and the starting power of the motor are reduced. Such a motor is switched, for example after a run-up, into a delta connection. In the star connection, the free ends of the phase strands of the three-phase motor are electrically connected to the outer conductors of an AC network. In the delta connection on the contrary, the phase-strands of the three-phase motor are connected in series so that one end of a phase-strand is connected to the beginning of the next phase-strand.

With this background, it is of interest to provide a connection apparatus in which the interconnection of the multiple conductors is easily altered between at least two different states.

In this respect, DE 2010 012 519 U1 provides a configuration plug for the conductive connection of one or more of the multiple terminals in at least two different positions to obtain at least two different types of circuits. The configuration plug is preferably set from the outside of a housing of the connection apparatus and rotated to change the circuit position.

This solution has proven itself. Nevertheless, there is a need for further optimization of the concept of the configuration plug.

The solution to this problem is the object of the invention.

SUMMARY OF THE INVENTION

Accordingly, a connection apparatus for connecting electrical devices such as electric motors to an AC system is disclosed. The connection apparatus includes a housing that has at least one housing portion in which a plurality of first and second conductor terminals are arranged, each conductor terminal having at least one or two or more individual terminals, and having a configuration plug for the conductive connection of one or more of the first and/or second conductor terminals in at least two different positions to obtain at least two different types of circuits. In this case, the configuration plug is rotatably and/or slidably guided in or on the housing or at least on the at least one housing portion relative thereto, and due to this relative movement, it can be rotated and/or slid into at least two different rotation and/or sliding positions in order to obtain at least two different types of circuits.

The configuration plug is retained on or in the housing or at least on or in a portion of the housing and its operation is further simplified so that operating errors or problems due to a loss of configuration plugs can be excluded.

In this case, contacts are formed on the configuration plug for contact with corresponding contacts of the conductor terminals in such a manner that with the configuration plug, one or more of the first and/or the second conductor terminals are conductively connected to one another. The conductive connection is such that when connecting a device such as an AC electric motor, a star connection is provided as a first type of circuit in the first rotational and/or sliding position and a delta connection is provided as a second type of circuit in the second rotational and/or sliding position of the configuration plug.

The configuration plug can be rotatably and/or slidably arranged in or on the housing, for example, in a straight or ring-segment-shaped or circular-segment-shaped groove or the like. The configuration plug may also be slidable or rotatable on a rotary bearing in order to be able to move it into the various configurations for a delta connection and a star connection. The movement of the configuration plugs can be a pure linear sliding movement or a pure rotation movement or a combined or superimposed sliding and rotation movement according to different embodiments.

The configuration plug may be arranged in the housing such as between the cover and a lower portion. However, it can protrude with an extension such as a handle extension from the housing.

According to a further embodiment, the housing includes the first housing portion and the configuration plug forms a further housing portion which is rotatable and/or slidable relative thereto and thus provides a housing function.

The configuration plug can thus also form a housing portion itself, i.e., it can form the cover which is movably guided on the lower housing portion with the conductor terminals or a cover for opening the lower housing portion on which it can be rotated or slid, or the lower housing portion. In the latter case, the lower housing portion can then be rotated and/or slid relative to the cover including the conductor terminals. The contacts of the configuration plugs are then arranged in the lower housing portion. This is movable relative to the cover with the conductor terminals relatively slidable. The cover is then the housing portion to which the configuration plug, as a lower housing portion, is relatively movable. The configuration plug is then slidably and/or rotatably guided on the housing portion and serves as another housing portion.

BRIEF DESCRIPTION OF THE FIGURES

In the following specification, the invention will be described in more detail with reference to the accompanying drawing in which.

DETAILED DESCRIPTION

Figure 1:
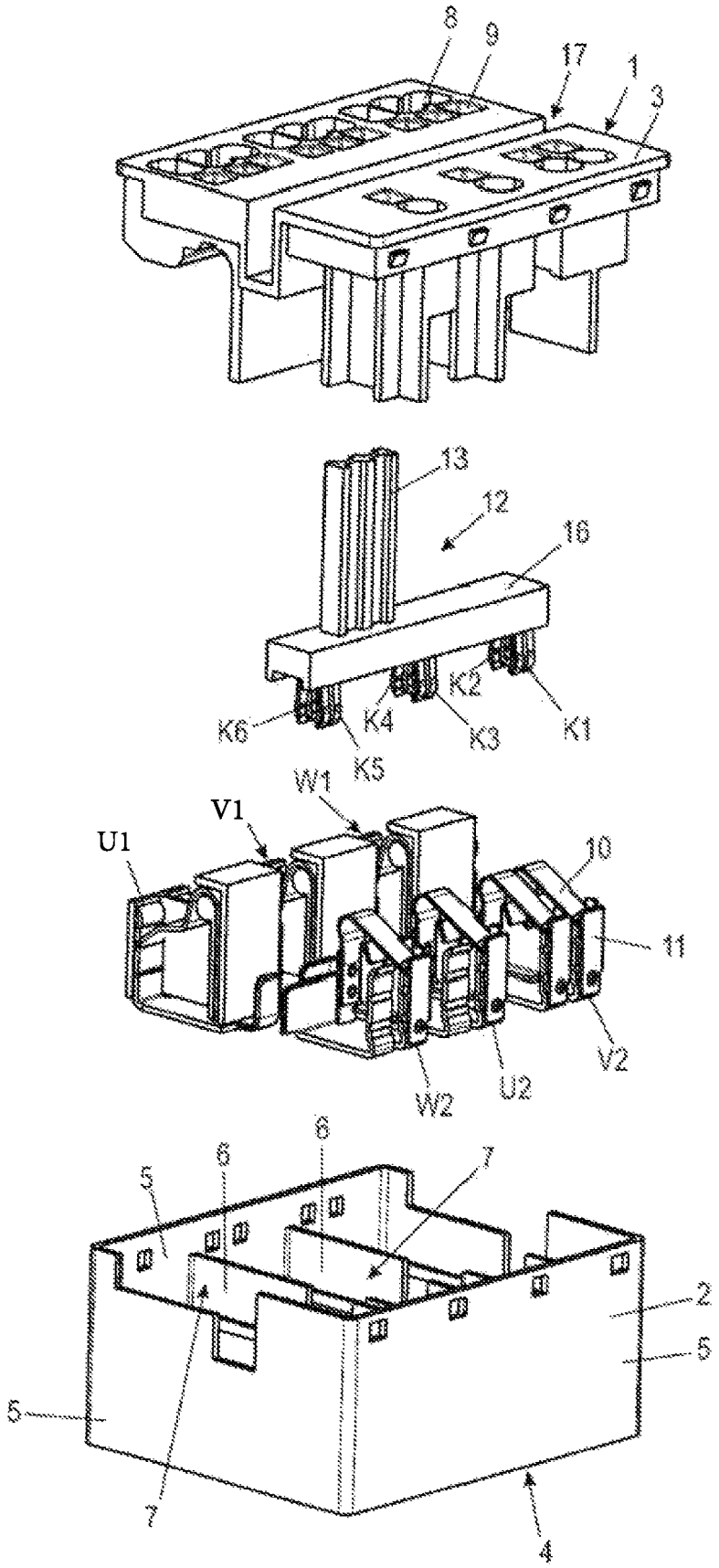
FIG. 1 is an exploded view of an embodiment of a connection apparatus according to the invention.
Figure 2A:
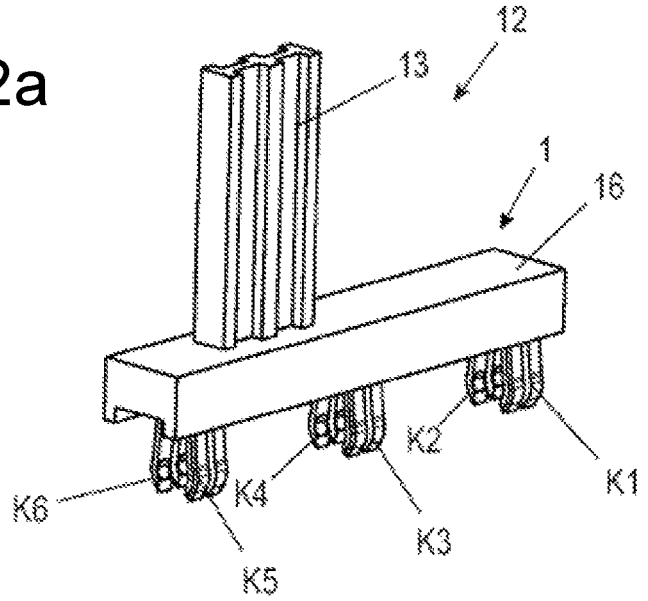
FIGS. 2*a* and 2*b* are perspective and exploded views, respectively, of a connection plug of the connection apparatus of FIG. 1.
Figure 2B:
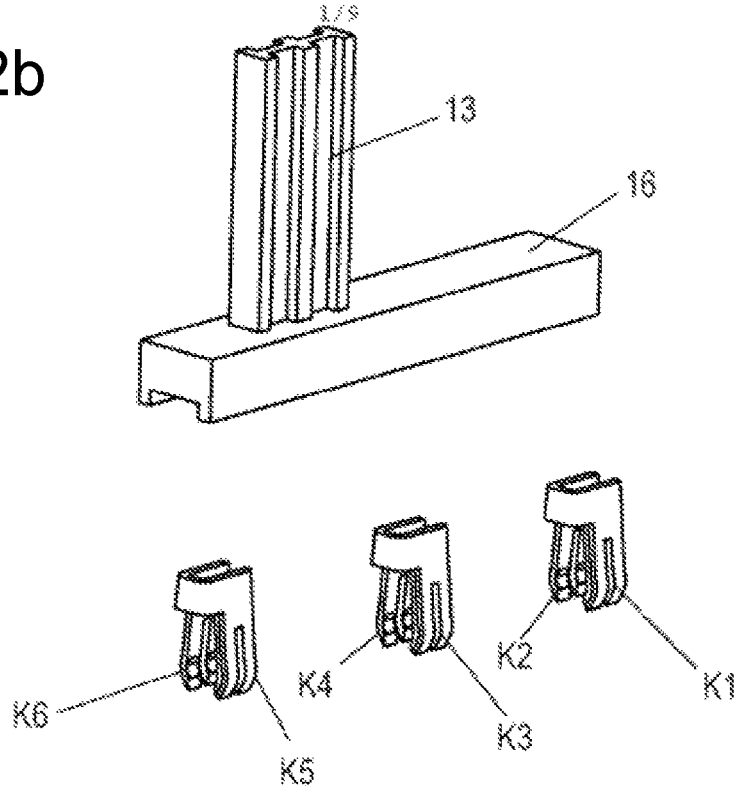

The connection apparatus of FIGS. 1 to 6 is used for connecting electrical devices, in particular electric motors, to an AC system. It has a housing 1, which preferably has a lower housing portion 2 and an upper housing portion or cover 3 which can be placed on the lower housing portion 2. In the drawing, the housing 1 is a separate housing. However, the housing 1 can also be attached to or integrally formed with another—higher-level—housing. The cover 3 can be latched to the lower housing portion 2.

The lower housing portion 2 has a base 4 and side walls 5 as well as partition walls 6, which define chambers 7 in which in the example shown, three first single or multiple conductor terminals W1, V1, U1 and three second single or multiple conductor terminals V2, U2, W2 are arranged. On the cover 3, corresponding contours or partition walls are also formed in order to define the chambers 7.

At least three first conductor terminals W1, V1, U1 and at least three second conductor terminals V2, U2, W2 are provided in the illustrated embodiments. These can be designed to connect a single conductor end or to connect several conductor ends. In this way, several devices such as motors or the like can be connected. For the conductor terminals W1, V2, U1 and V2, U2, W2, openings 8 are formed in the cover 3. In addition, openings 9 for releasing the conductors from the conductor terminals W1, V2, U1, V2, U2, W2 using tools such as screwdrivers or actuators are provided on the housings 1, in particular on its covers 3.

The first conductor terminals W1, V1 and U1 are each designed in a preferred embodiment for the connection of three conductor ends. On the other hand, the second conductor terminals V2, U2, W2 are designed for the connection of one or two conductor ends.

According to the preferred embodiment, individual conductor terminals are also designed as single or multiple direct plug-in connections (push-in connections), each with a clamping spring 10 and a busbar 11. Each terminal may further be provided with a clamping cage which may be formed from the busbars 11. However, the first and/or second conductor terminals W1, V, U1; V2, U2, W2 can also be designed with other connection configurations such as screw-connections or spring-cage connections.

The embodiment wherein the conductor terminals W1, V2, U1 and the conductor terminals V2, U2, W2 are direct plug connections is particularly advantageous because it leads to a compact design and the respective conductor terminals can be manufactured quickly and reliably.

On or preferably in the housing 1, a configuration plug 12 is also slidably guided. The configuration plug 12 includes an extension 13 which protrudes from the housing 1. Preferably, it protrudes with a handle extension 13 from an opening 14 of the cover 3.

The configuration plug 12 has several contacts K1, K2, K3, K4, K5, K6 as shown in FIG. 1. These contacts K1-K6 are in the assembled state of the connection apparatus, preferably in the interior of the housing 1.

Two of the contacts K1, K2 or K3, K4 as well as K5 and K6, are conductively connected to one another. The contacts K1 to K6 are formed at free ends of spring struts or formed as spring contacts.

The configuration plug 12 with the contacts K1 to K6 can be moved or pushed within the housing into at least two different positions S1, S2 which provides various circuits or types of circuits S1. S2 for the operation or supply of motors.

Figure 3A:
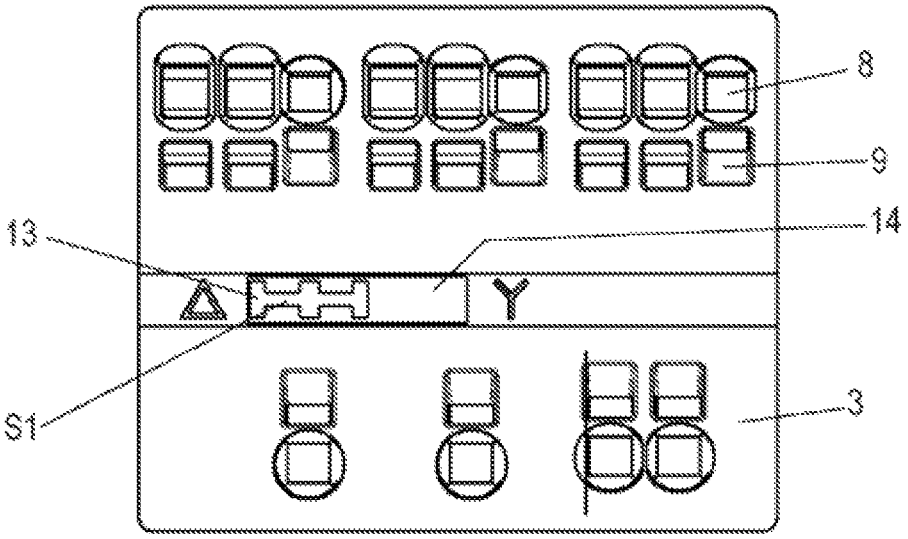
FIGS. 3*a* and 3*b* are top plan views of the connection apparatus of FIG. 1 in first and second configurations, respectively.
Figure 3B:
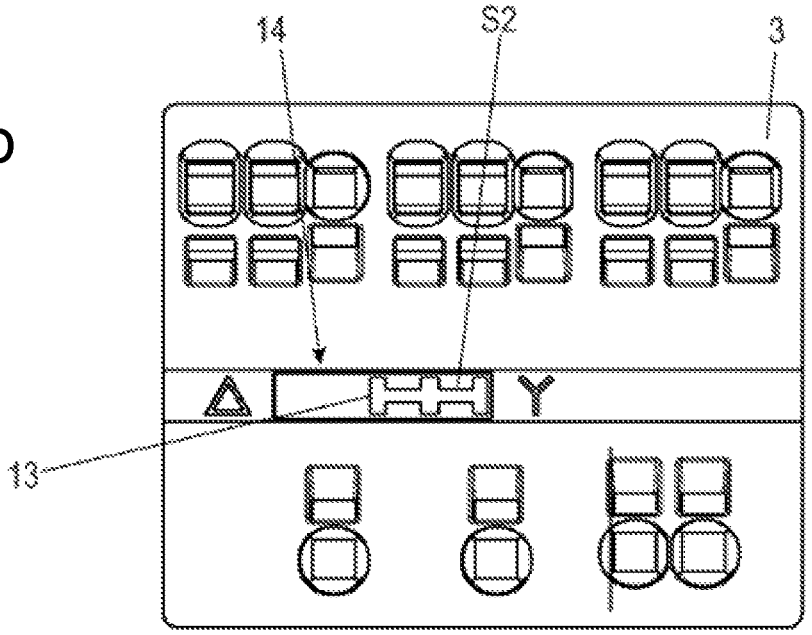
Figure 4A:
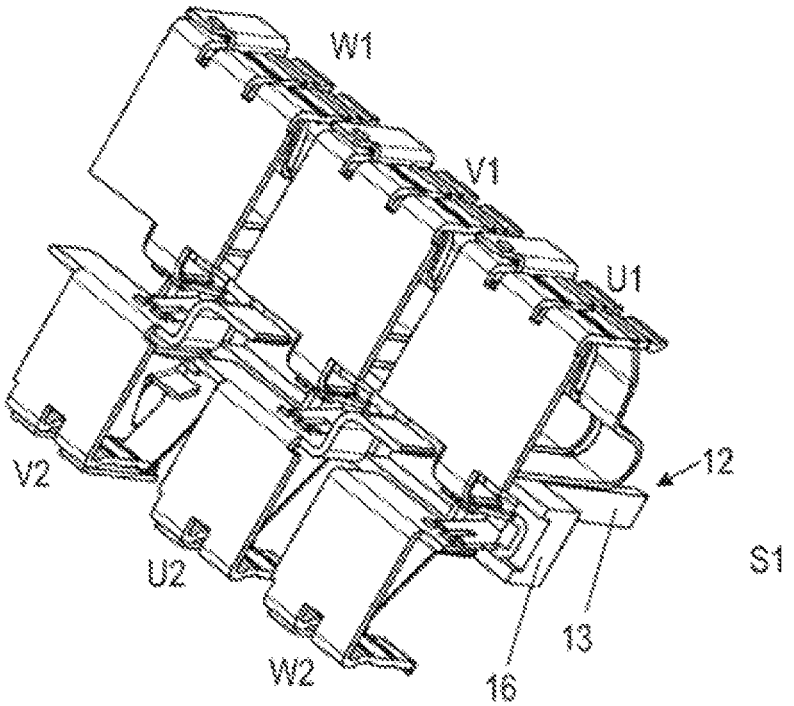
FIGS. 4*a* and 4*b* are bottom perspective views of a metal subassembly and the connection plug of the connection apparatus of FIG. 1 in the first and second configurations, respectively.
Figure 4B:
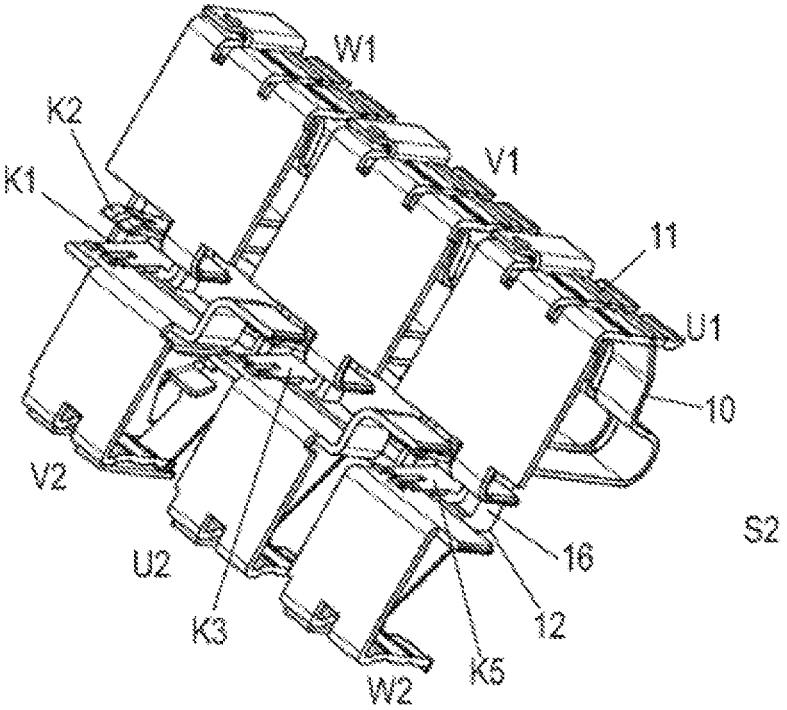

One of these positions S1 which is shown in FIG. 3*b* is used to create part of a star connection and the other position S2 is used to create part of a delta connection as shown in FIG. 3*a*. These circuits are completed in the field by other devices such as electric motors and a three-phase supply and possibly other components.

The contacts K1 to K6 of the configuration plug 12 are formed for the contact of the corresponding contact areas on the first and second conductor terminals.

At the first and second conductor terminals W1, V1, U1 and W2, U2, V2, two or three contact areas KW1, KV1 and KU1 as well as KW2, KU2-1, KU2-2, KU2-3, KV2-1, KV2-2 and KV2-3 are formed corresponding with the first contacts K1 to K6. The one, two or three contact areas KW1 and KW2 or KU2-1, KU2-2, KU2-3 and KV2-1, KV2-2 and KV2-3 can be conductively connected to one another. They are then formed, for example, by different contact areas on a correspondingly shaped busbar element. This is illustrated in FIGS. 6 and 7.

These contacts are electrically connected to the respective corresponding conductor terminals W1, V1, U1 or V2, U2 and W2. They can be integrally formed, e.g., as tongues or webs from the material of the busbars of these connections. Individual contacts of KW1, KV1 and KU1 as well as KW2, KU2-1, KU2-2, KU2-3, KV2-1, KV2-2 and KV2-3 are located on both sides of a straight channel 15 in the housing 1.

Figure 5A:
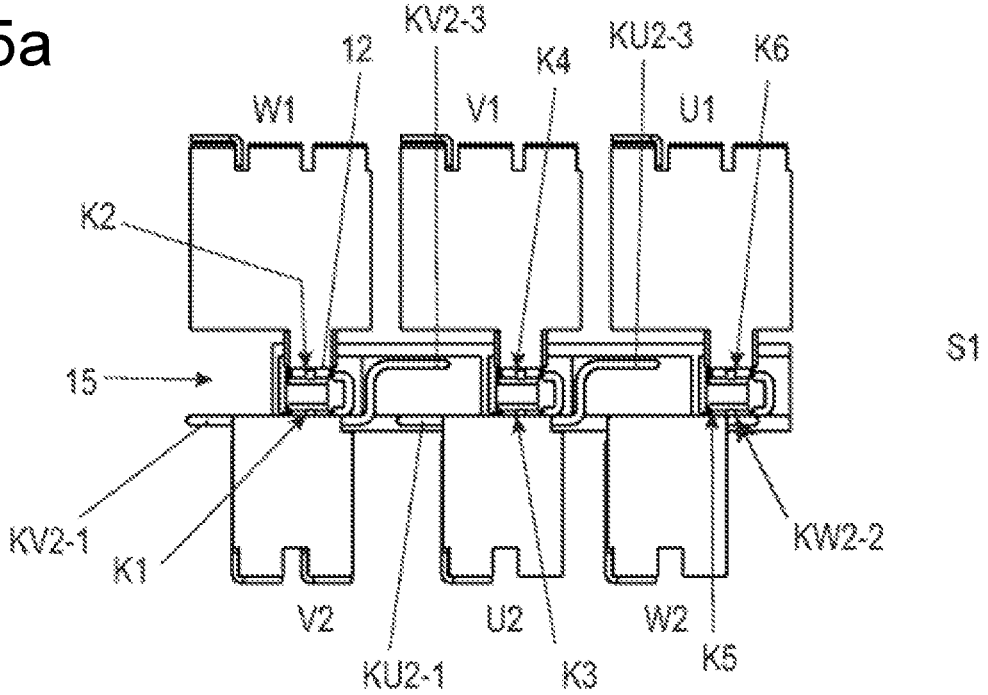
FIGS. 5*a* and 5*b* are bottom plan views of the components of FIG. 4 in the first and second configurations, respectively.
Figure 5B:
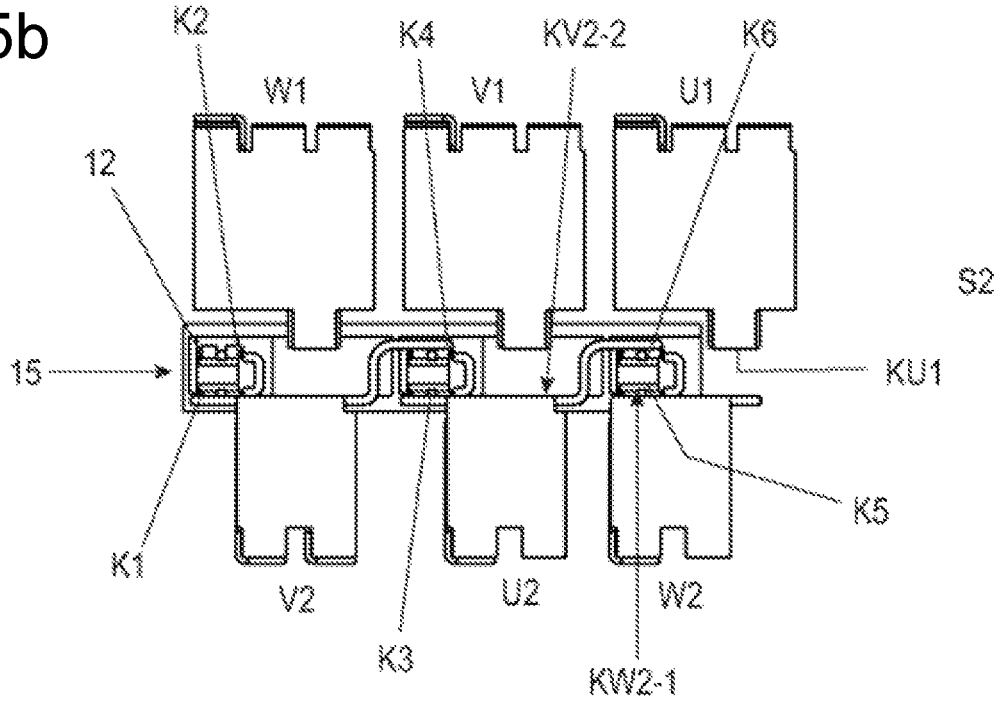
Figure 6A:
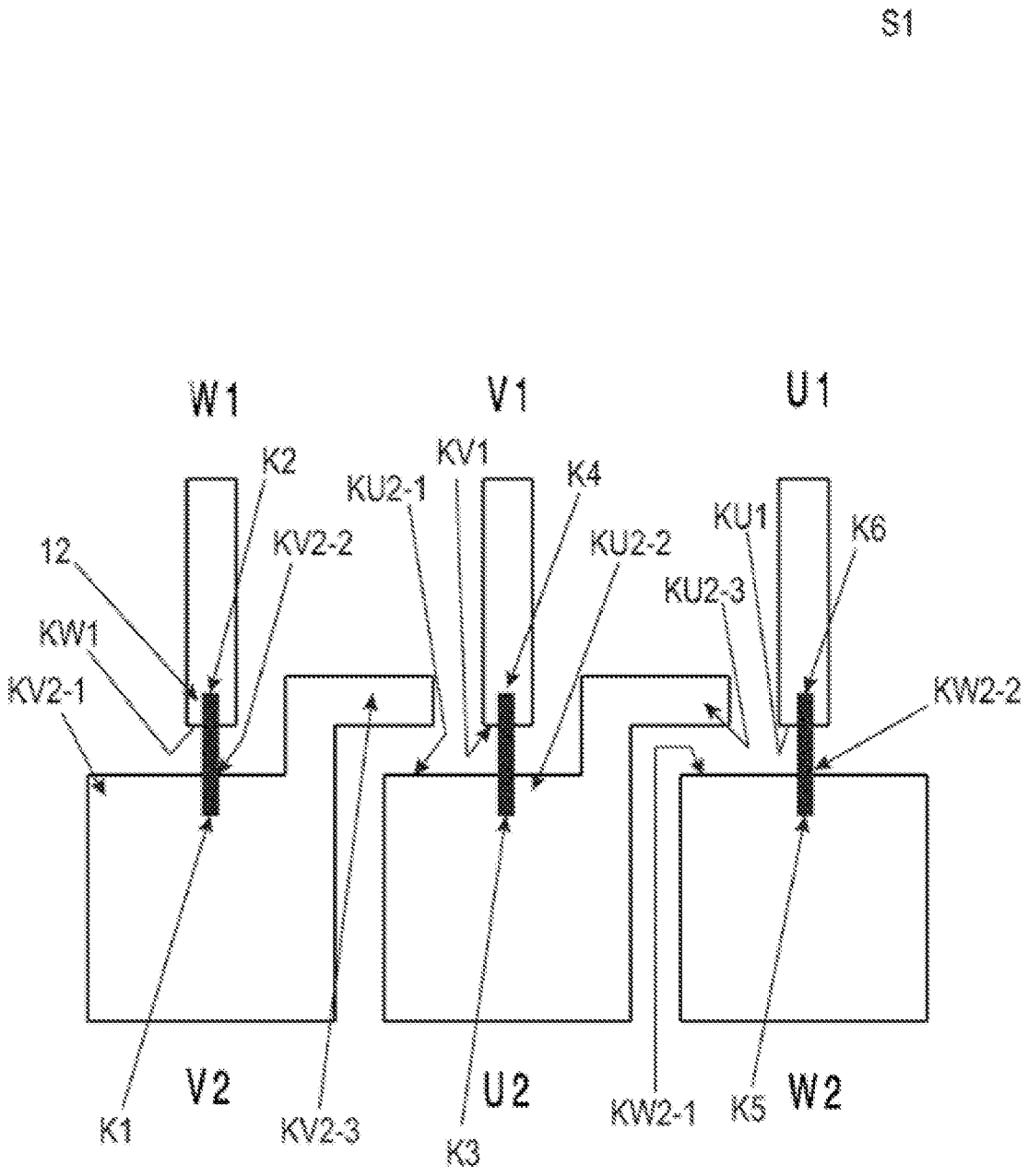
FIGS. 6*a* and 6*b* are schematic diagrams illustrating the function and structure of the connection apparatus of FIG. 1 in the first and second configurations, respectively.
Figure 7B:
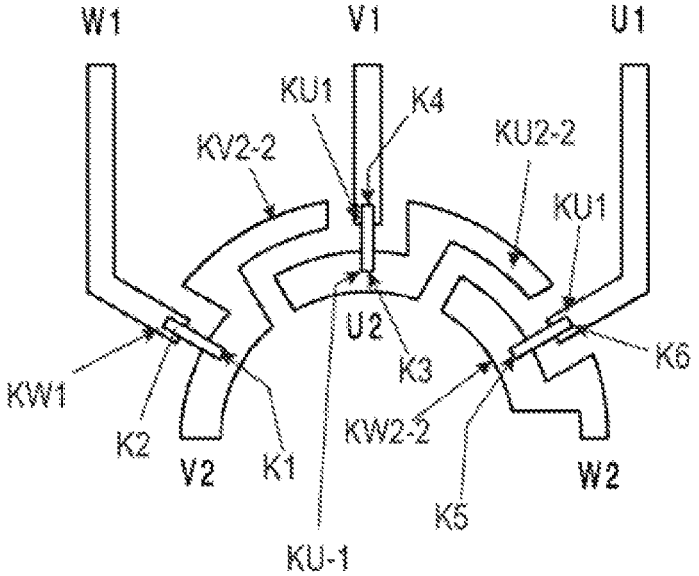
FIGS. 7*a* and 7*b* are schematic diagrams illustrating the function and structure of a further embodiment of the connection apparatus of FIG. 1 in the first and second configurations, respectively.
Figure 7A:
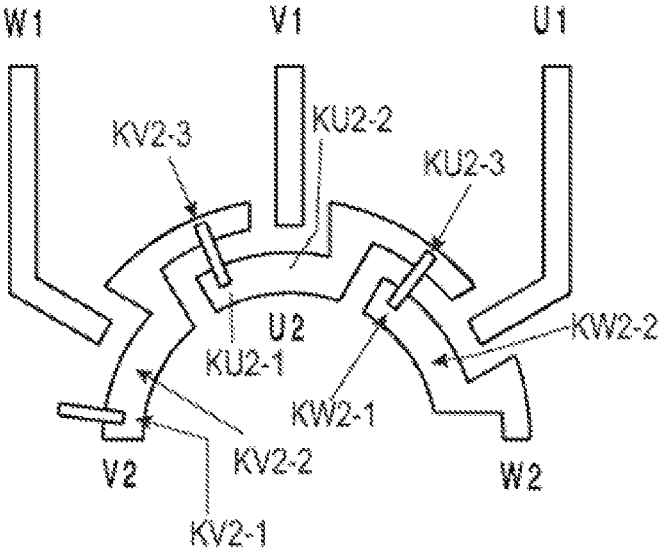

The contacts K1 to K6 of the configuration plugs 12 contact, in a first configuration or slide position S1, the contact areas KW1, KV1 and KU1 as well as KW2-1, KW2-2, KU2-1, KU2-2, KU2-3, KV2-1, KV2-2 and KV2-3 in such way that a delta connection is obtained as shown in FIG. 5*a* or 6*a*. On the other hand, the contacts K1 to K6 of the configuration plug 12 contact, in a second slide position S2, the contact areas KW1, KV1 and KU1 as well as KW2-1, KW2-2, KU2-1, KU2-2, KU2-3, KV2-1, KV2-2 and KV2-3, in such a way that a star connection is obtained as shown in FIGS. 5*b* and 7*b*.

Figure 6B:
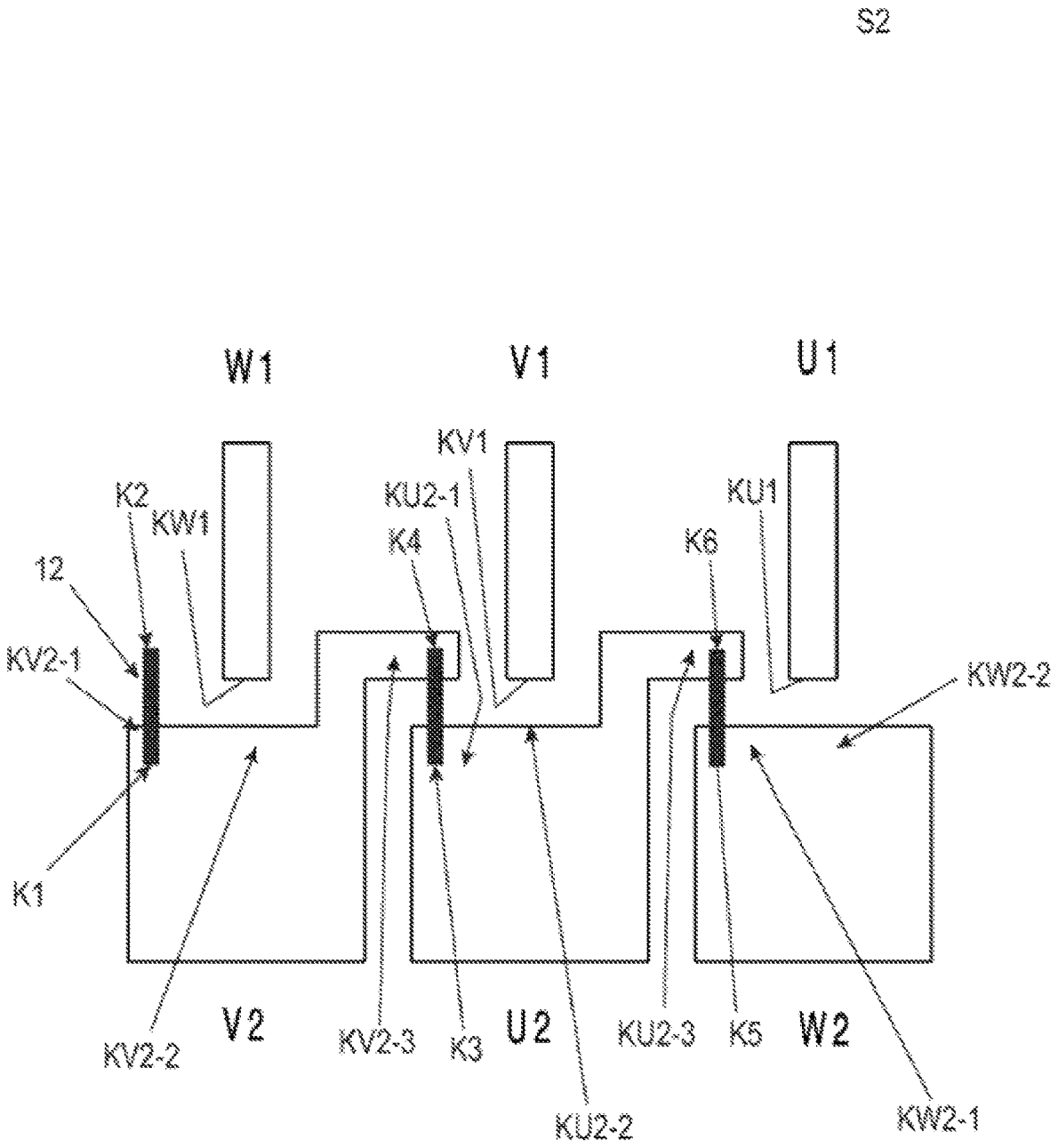

This can be realized simply by the fact that at least two of the second conductor terminals have contact areas KU2-1, KU2-2, KU2-3, KV2-1, KV2-2 and KV2-3 on both sides of the channel 15 between them but are conductively connected to one another. In this way, the two types of circuits of FIG. 6*a* and FIG. 6*b* can be implemented in a simple manner. FIGS. 6 and 7 show schematic representations of the metal parts of FIGS. 4 and 5, respectively, and can thus be transferred directly to these figures.

For this purpose, the contacts K1-K6 of the configuration plugs 12 are formed as spring contacts on an insulating bar 16, and the contacts of the first and second conductor terminals form a channel in which the configuration plug 12 is slidably guided in order to contact the corresponding contacts of the respective first and/or second conductor terminals with the spring contacts K1 to K6 in the first and second sliding positions S1, S2, respectively in the manner shown in FIG. 6 or FIG. 7.

Similarly, a channel 17 may be formed in the housing 1, in particular in the cover 3, in which channel the opening 14 is formed, which is penetrated by the handle extension 13.

In this way, in addition, the sliding function is visually easily recognizable. On the housing 1, signs such as a triangle or a star can be provided in order to illustrate in which sliding position S1 or S2 a configuration or circuit type is realized.

The configuration plug 12 is preferably arranged and retained in the housing 1. The insulating bar 16 and the handle extension 13 shown in FIGS. 2*a* and 2*b* may be integrally made of plastic.

According to FIG. 7, the contacts of the configuration plug 12 and of the conductor terminals on the housing are not distributed on a straight channel but distributed on a circular arc segment-like channel. Then the configuration plug 12 is arranged rotatably and/or slidably on the housing 1, for example, on a ring-segment-shaped or circular-segment-shaped groove or the like, or rotatably on a rotary bearing in order to be able to be moved between the delta connection and star connection. The movement of the configuration plugs 12 can in this embodiment be a pure rotation or a superimposed rotation and sliding movement.

Figure 8A:
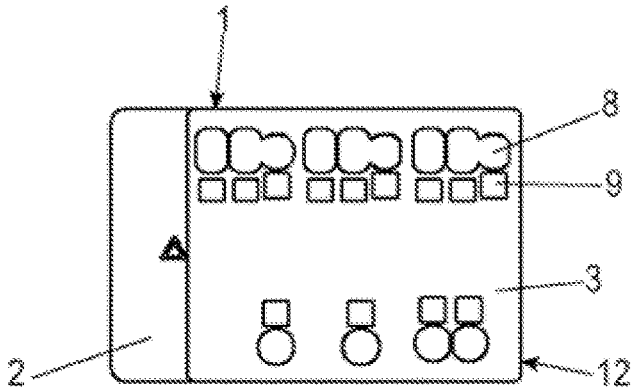
FIGS. 8*a*, 8*b*, and 8*c* are schematic diagrams illustrating the function and structure of another embodiment of the connection apparatus of FIG. 1 in delta, neutral and star configurations, respectively.
Figure 8B:
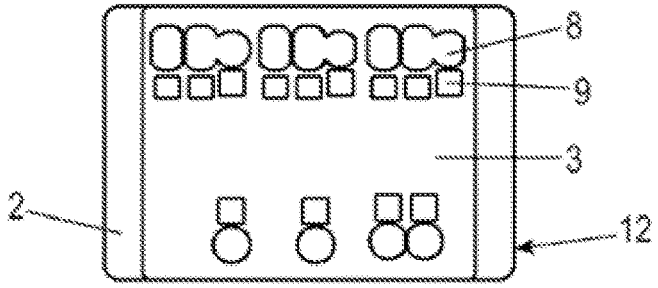
Figure 8C:
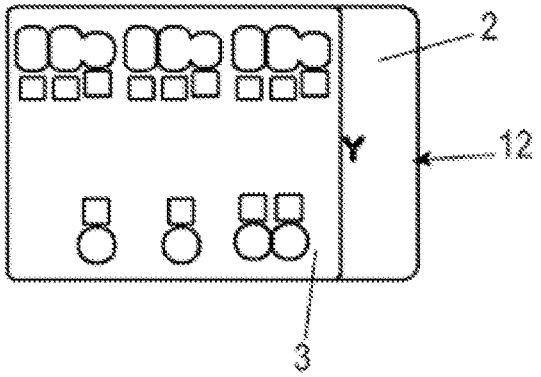

According to FIG. 8, the configuration plug 12 can also form a housing portion such as the lower housing portion. This portion is slidable relative to the cover 3 as a further housing portion with the conductor terminals (see the openings 8, 9), because the cover 3 is slidable on the lower housing portion 2. The contacts of the configuration plugs 12 are then arranged in the lower housing portion 2. This is movable or slidable relative to the cover 3 with the conductor terminals.

The configuration plug 12 is then relatively slidably guided on the housing portion although it also serves a housing function, namely that of the lower housing portion 2.

It should also be noted that there may be other sliding or rotational positions such as a neutral position as shown in FIG. 8*b* if a corresponding number of contacts are provided and arranged.

The invention claimed is:

1. A connection apparatus for connecting electric motors to an AC system, comprising (a) a housing including at least one housing portion;

(b) a plurality of first and second conductor terminals arranged in spaced relation within said one housing portion, said first conductor terminals including first direct plug-in contacts, respectively, and said second conductor terminals including second direct plug-in contacts, respectively; and (c) a configuration plug including an insulating bar arranged within said one housing portion and a plurality of third contacts on said insulating bar, said configuration plug being guided for at least one of rotation and sliding movement of said insulating bar relative to said housing between at least two different positions while remaining fully captive within said one housing portion, said third contacts contacting said first and second direct plug-in contacts in two different configurations in said two different positions to define one of a delta connection when said configuration plug is in the first position and a star connection when said configuration plug is in the second position for selectively connecting electrical devices.

2. The connection apparatus as defined in claim 1, wherein said direct plug-in contacts each include at least one clamping spring and a busbar.

3. The connection apparatus as defined in claim 2, wherein at least two of said direct plug-in contacts are combined into a multiple connection.

4. The connection apparatus as defined in claim 1, wherein said housing contains at least one insertion opening for the insertion of a conductor into said conductor terminals.

5. The connection apparatus as defined in claim 1, wherein said third contacts of said configuration plug are formed as spring contacts.

6. The connection apparatus as defined in claim 5, wherein said insulating bar includes a handle extension which protrudes outwardly from said housing and said configuration plug is retained within said housing.

7. The connection apparatus as defined in claim 1, wherein said housing contains a channel extending between said first and second conductor terminals, said configuration plug being slidably guided within said channel.

8. The connection apparatus as defined in claim 7, wherein said channel is one of straight and arcuate.

9. The connection apparatus as defined in claim 1, wherein said at least one housing portion comprises a lower housing portion and said housing further includes an upper housing portion.

10. The connection apparatus as defined in claim 1, wherein said configuration plug defines at least one further housing portion which is one of rotatable and slidable relative to said at least one housing portion.

11. A connection apparatus for connecting electric motors to an AC system, comprising (a) a housing including a lower portion containing a chamber and an upper portion for closing chamber, said housing upper portion containing an opening;

(b) a plurality of first conductor terminals arranged in said chamber and including first direct plug-in contacts, respectively;

(c) a plurality of second conductor terminals arranged in said chamber and including second direct plug-in contacts, respectively, said second conductor terminals being arranged in spaced relation relative to said first conductor terminals; and (d) a configuration plug movable between first and second positions relative to said housing, said configuration plug including (1) an insulating bar arranged and fully captive within said housing chamber and including a plurality of third contacts configured to contact selected first and second direct plug-in contacts of said first and second conductor terminals, respectively; and (2) an extension connected with said insulating bar and extending from said housing upper portion via said opening which guides the movement of said configuration plug between the first and second positions, said configuration plug defining a portion of a delta connection between said first and second terminals when said configuration plug is in the first position and said configuration plug defining a portion of a star connection between said first and second conductor terminals when said configuration plug is in the second position.

* * * * *